United States Patent [19]

Otis

[11] 4,234,265

[45] Nov. 18, 1980

[54] LIGHT TRANSMITTING ROADWAY MARKER

[76] Inventor: George A. Otis, 715 E. Los Angeles Dr., Vista, Calif. 92083

[21] Appl. No.: 772,455

[22] Filed: Feb. 28, 1977

[51] Int. Cl.[3] ..... E01F 9/04

[52] U.S. Cl. ..... 404/16; 350/97; 350/101

[58] Field of Search ..... 404/16; 350/96 R, 97, 350/101

[56] References Cited

U.S. PATENT DOCUMENTS

| | | | |
|---|---|---|---|
| 1,903,748 | 4/1933 | Woolums | 404/16 |
| 2,301,185 | 11/1942 | Arnold | 350/96 R X |
| 2,507,035 | 5/1950 | Maynard | 350/96 R X |
| 2,708,858 | 5/1955 | DeShazor | 404/16 |
| 2,907,249 | 10/1959 | Hjermstad | 350/101 |
| 2,991,698 | 7/1961 | Leubaz | 404/16 |
| 3,217,292 | 11/1965 | Henderson | 350/96 R X |
| 3,332,327 | 7/1967 | Heenan | 404/16 |
| 3,694,945 | 10/1972 | Detiker | 350/101 X |

*Primary Examiner*—Nile C. Byers, Jr.
*Attorney, Agent, or Firm*—Clement H. Allen

[57] ABSTRACT

A roadway lane marker has a translucent body to receive light from a vehicle's headlights on its back window, the light being transmitted through the marker body to illuminate its front face. A plurality of such markers, implanted at spaced intervals along edges of roadway lanes, will delineate to a driver looking back from a vehicle entering a roadway at night from a merging side road or ramp, the lane in which a vehicle generally behind him is approaching.

3 Claims, 11 Drawing Figures

FIG. 7.
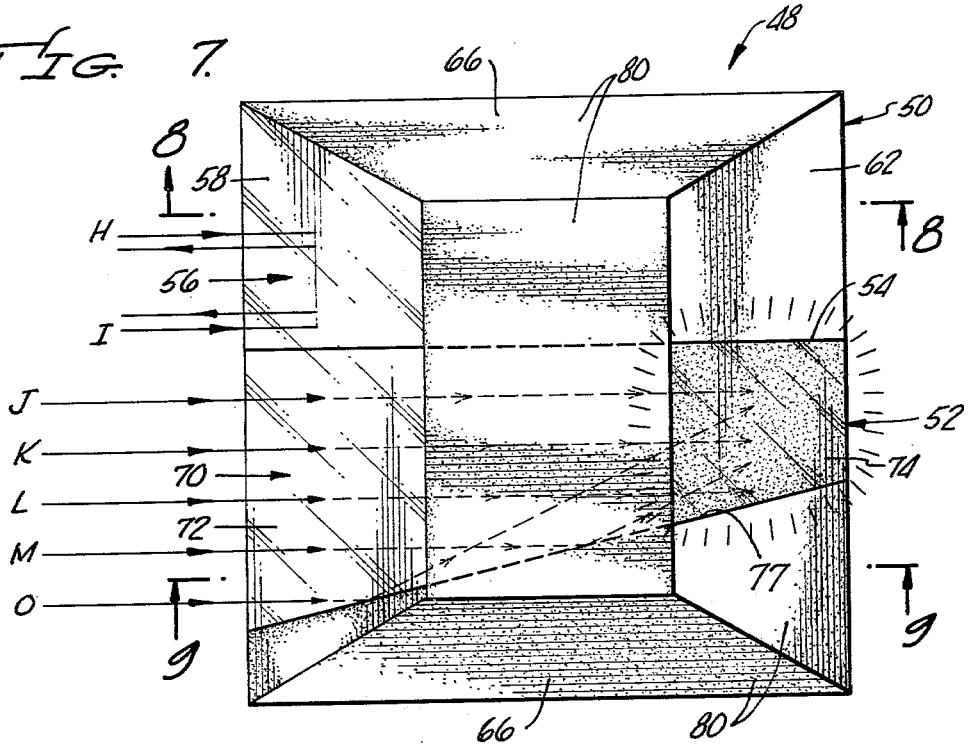
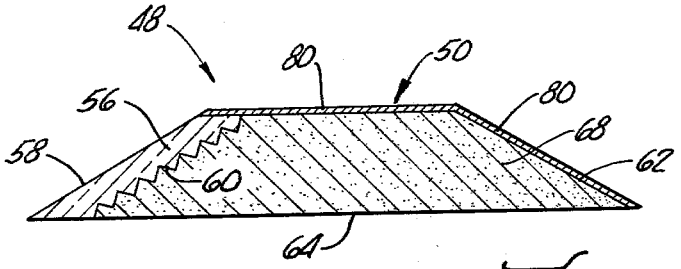
FIG. 8.
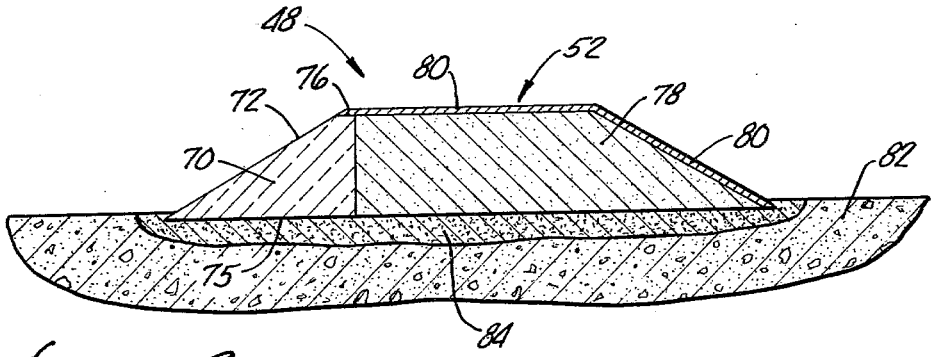
FIG. 9.

LIGHT TRANSMITTING ROADWAY MARKER

BACKGROUND OF THE INVENTION

1. The Field of the Invention

This invention relates to an illuminatable roadway marker, and more particularly to a light transmitting roadway marker.

2. The Prior Art

Illuminatable roadway markers have been widely used in large numbers for warning signs and for delineating roadway traffic lanes. Such markers, however, appear to have been exclusively of the light reflecting type, which have reflected light from a vehicle's headlights back toward the driver of that vehicle. The reflective nature of such markers has made them useful for warning the driver of the vehicle illuminating them of various road and lane locations and conditions. However, they have not been useful at all for warning drivers of vehicles which may be ahead, or generally ahead, of another.

An extremely dangerous situation exists on many multi-lane roadways or freeways when a vehicle approaches the outer lane at an angle from a merging on-ramp or cross road. The driver must look back, either directly or through his rear view mirror, to see if any vehicles are approaching in the lane he is about to enter. But often all he sees is an array of glaring headlights against a comparatively dark or black background, containing no reference or markers by which the lanes in which vehicles are approaching can be identified. Reflective buttons which guide a driver in his road ahead are, of course, completely useless for providing any guidance or information about lanes or conditions behind.

A roadway marker which would be illuminatable by a vehicle's headlights to warn a vehicle generally ahead of him of his presence and lane position would be advantageous and contribute in great measure to multi-lane highway or freeway driving safety.

SUMMARY OF THE INVENTION

The roadway marker of this invention is of a light transmitting type and attachable to a roadway surface to indicate the lane in which a vehicle is travelling at night from a viewpoint generally ahead of that vehicle, as from another vehicle entering from a merging side road or ramp. The marker comprises a translucent body having a back window and a light scattering front face, the body adapted to receive light falling on its back window and to transmit such light to illuminate its front face which will be visible from a viewpoint generally ahead of the vehicle. Preferably, the area of the front face illuminated is smaller than the area of the back window on which the light falls. A roadway marking system contemplates attaching a series of such markers at spaced intervals along an edge or edges of lanes of multi-lane roadways.

BRIEF DESCRIPTION OF THE DRAWINGS

In the drawings:

FIG. 7 shows a top view of another embodiment of the roadway marker of this invention.

FIG. 8 shows a vertical longitudinal section of the roadway marker of FIG. 7 taken along the line 8—8.

FIG. 9 shows a vertical longitudinal section of the roadway marker of FIG. 7 taken along the line 9—9.

DESCRIPTION OF PREFERRED EMBODIMENTS

Figure 1:
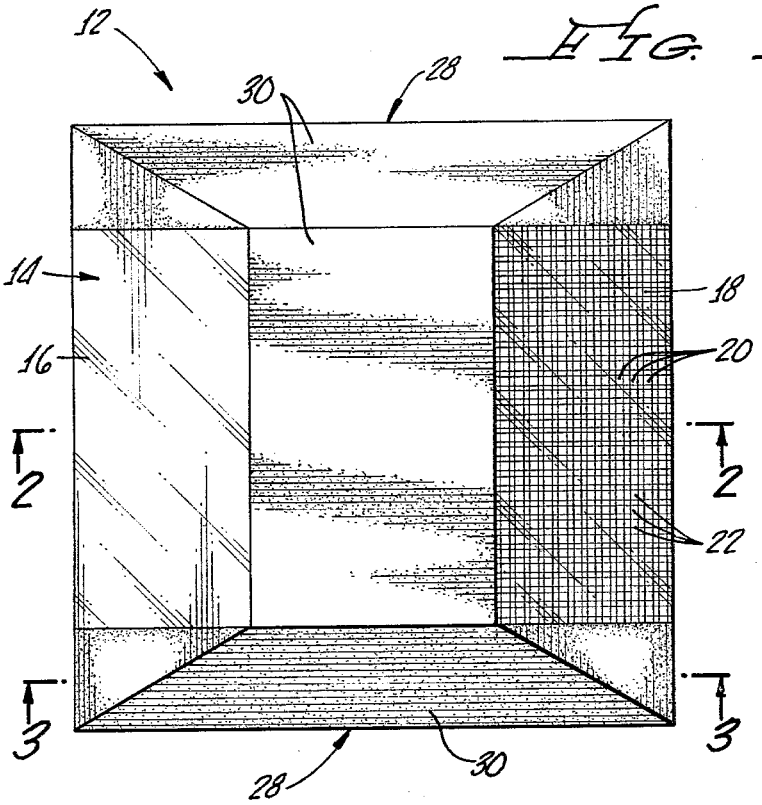
FIG. 1 shows a top view of a roadway marker embodying features of this invention.
Figure 2:
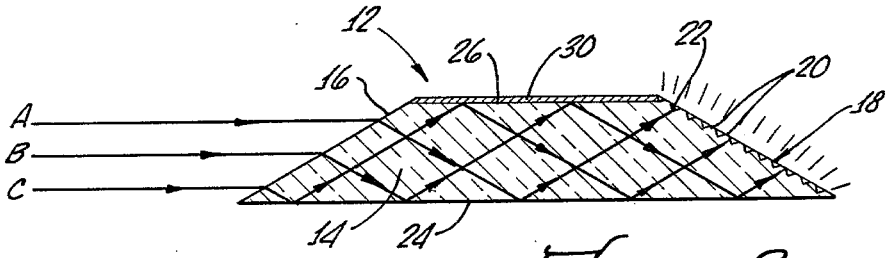
FIG. 2 shows a vertical longitudinal section of the roadway marker of FIG. 1 taken along the line 2—2.
Figure 3:
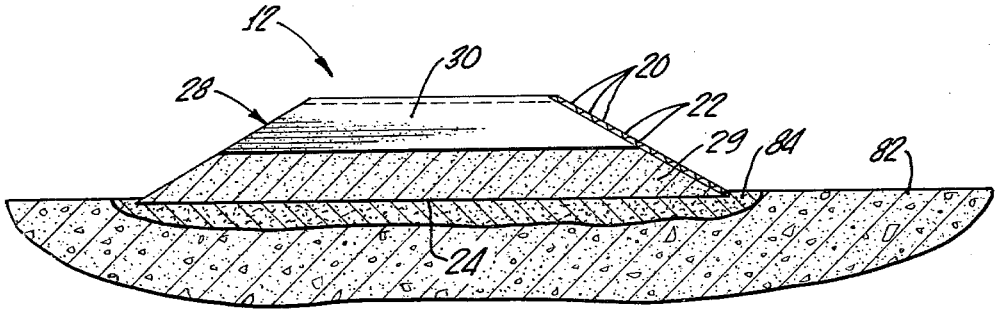
FIG. 3 shows a vertical longitudinal section of the roadway marker of FIG. 1 taken along the line 3—3.

Referring now to FIGS. 1 to 3, a roadway marker 12 comprises a translucent body 14 fabricated of transparent material, such as acrylic plastic, and having a clear, polished back window 16 at one end and a contoured, light scattering front face 18 which may comprise lateral ridges 20 and longitudinal ridges 22 at its other, opposite end. Back window 16 and front face 18 are inclined at an acute angle, preferably about 30 degrees, to bottom 24 of body 14. Top 26 of body 14 is parallel to its bottom 24 and both these surfaces are preferably polished and "silvered" by conventional deposition thereon of a coating of bright metal such as chromium or aluminum. Side pieces 28 adhesively attached to each side of body 14 are filled with cast or otherwise formed cementitious material 29 such as epoxy putty or so-called mastic; side pieces 28 and top 26 of body 14 being coated on their outsides with a relatively thin, enclosing cover 30 of a tough, long wearing ordinarily opaque material, such as polypropylene, leaving back window 16 and front face 18 uncovered for transmission of light. The angle of the sides of side pieces 28 to bottom 24 will be generally greater than that of the back window 16 and front face 18, and may be of the order of 45 to 60 degrees. Overall dimensions of a commercially useful roadway marker may be about 4 inches long, that is from back to front, 4 inches wide, and $\frac{5}{8}$ inch high, to provide adequate light transmitting area and relatively low profile.

As seen in FIG. 2, typical light rays A, B, and C entering back window 16 of body 14 will be refracted downwardly by the interface and will then be internally reflected by bottom 24 and top 26, and will exit as scattered light through contoured front face 18. The precise refractive angle will of course depend on the index of refraction of the material employed. It will be apparent from FIG. 2 and the general light paths shown, that body 14 is continuously transparent between back window 16 and front face 18.

Figure 4:
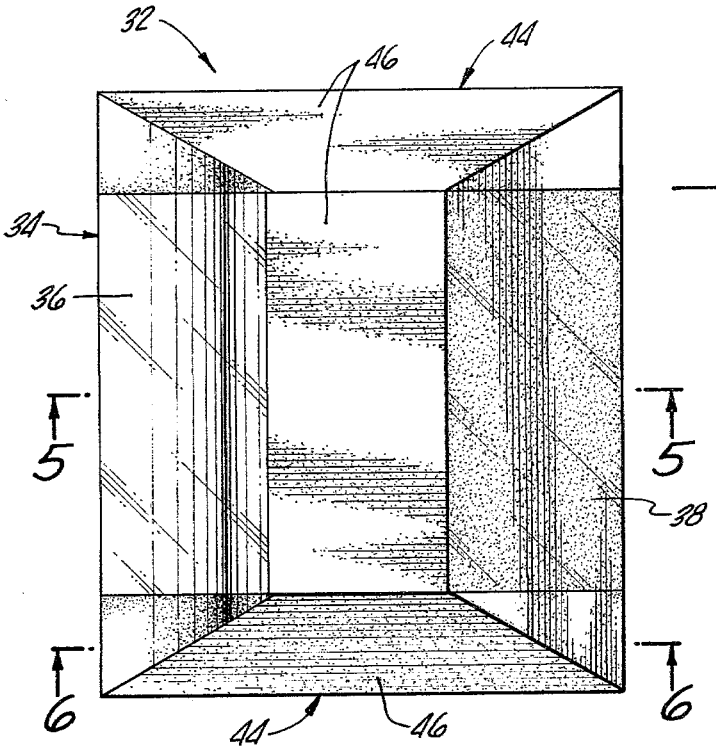
FIG. 4 shows a top view of an alternative embodiment of the roadway marker of this invention.
Figure 5:
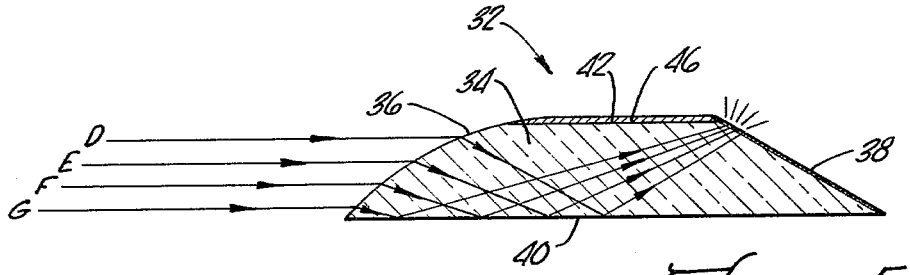
FIG. 5 shows a vertical longitudinal section of the roadway marker of FIG. 4 taken along the line 5—5.
Figure 6:
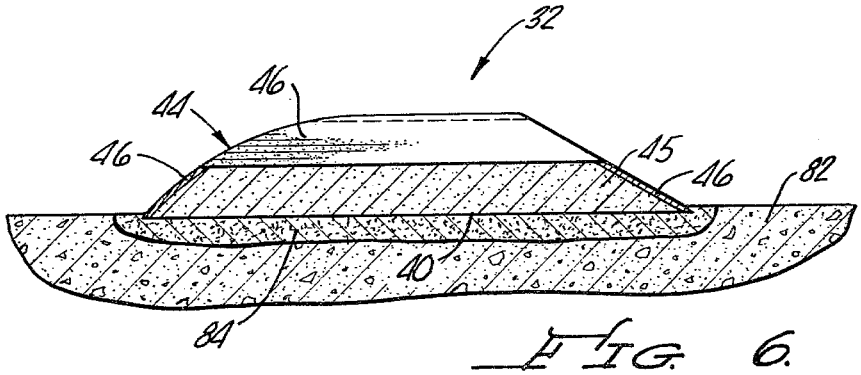
FIG. 6 shows a vertical longitudinal section of the roadway marker of FIG. 4 taken along the line 6—6.
Figure 10:
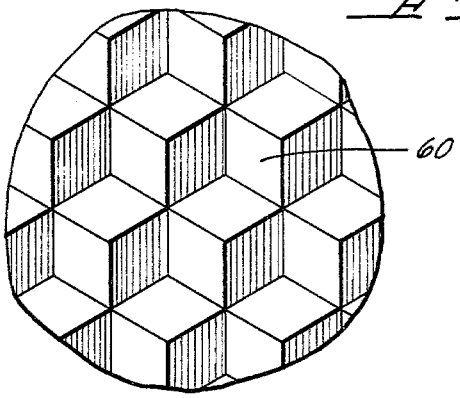
FIG. 10 shows a fragmentary detail view of the front face of the reflecting element in the embodiment of FIGS. 7 to 9.

Referring now to FIGS. 4 to 6, the roadway marker 32 comprises a translucent body 34 also fabricated of transparent material such as acrylic plastic, and having a clear, polished and curvate back window 36, and a light scattering frosted front face 38. Back window 36 and front face 38 are inclined at a general angle of about 30 degrees to bottom 40 of body 34. Top 42 of body 34 is parallel to bottom 40 and the surface of bottom 40 is preferably polished and silvered like the top and bottom of the embodiment of FIGS. 1 to 3. Side pieces 44 are adhesively attached to each side of body 34 and are also filled with cementitious material or mastic 45 and these, together with top 42 of body 34 are also coated on their outsides with a tough plastic cover 46. The angle of the side faces of side pieces 44 are inclined, like those of the previously described embodiment, at an angle of about 45 to 60 degrees to bottom 40 of body 34. Overall dimensions of such a roadway marker may be about 3 inches long, that is from back to front, 4 inches wide, and $\frac{5}{8}$ inch high.

As seen in FIG. 5, curvate back window 36 forms a lenticular interface which refracts typical light rays D, E, F, and G downwardly in a focusing path to the interior surface of bottom 40 where they are internally reflected to produce a narrow, brightly illuminated band at or near the top of frosted front face 38. The degree of curvature of back window 36 will depend, according to known optical principles, on a number of factors including the index of refraction of the material of body 34 and its dimensions and shape. In the example illustrated with the dimensions given, the radius of curvature of back window 36 should be about 2 inches.

FIGS. 7 to 10 illustrate an embodiment of the invention which combines a light transmitter and a light reflector type roadway marker. The roadway marker 48 comprises a light reflecting part 50 and a light transmitting part 52 adhesively joined together as at 54, as will be seen in FIG. 7. Light reflecting part 50 comprises a thin reflecting element 56 fabricated of a transparent material such as acrylic plastic and having a plane, polished back face 58 and a generally parallel front face 60 which is contoured to reflect light entering back face 58 back toward its source. The contoured surface 60 of reflector element 56 may advantageously be of the conventional "cube on edge" reflex design as illustrated in the enlarged fragmentary view of FIG. 10. As shown in FIG. 7, typical light rays H and I entering element 56 through its back face 58 will be reflected internally by contoured surface 60 and directed back toward their original source as shown. Back face 58 and front 62 of light reflector part 50 are inclined about 30 degrees to its bottom 64, and sides 66 of both part 50 and transmitter part 52 are inclined between about 45 and 60 degrees to the plane of bottom. The interior of reflector part 50 is filled with cementitious material or mastic 68, and surface 60 of reflector element 56 is preferably silvered to preserve its reflecting qualities when in adhesive contact with filler or mastic 68.

Light transmitter part 52 of roadway marker 48 comprises translucent body 70 fabricated of transparent material such as acrylic plastic having a plane, polished back window 72 and a frosted front face 74 both of which are inclined at an angle of about 30 degrees to bottom 75, which extends in the same plane as the bottom 64 of reflector part 50. Bottom 75 and top 76 of body 70 are polished and preferably silvered. Back window 72 and front face 74 form lateral extensions of back face 58 and front 62 of reflector part 50. The central side at 54, of light transmitter part 52, is generally parallel to marker sides 66 in a vertical plane, but its outer side 77, which is also plane, polished and preferably silvered, is inclined inwardly toward the front at an angle of about 76 to 78 degrees to the lateral plane of back window 72, and is also perpendicular to bottom 75. The remainder of the interior of light transmitter part 52 is filled with cementitious material or mastic as at 78. The entire marker including reflector part 50 and transmitter part 52 is coated with a thin plastic cover 80, preferably of tough wear resistant material such as polypropylene, except for the areas of back face 58 of reflector part 50 and back window 72 and front face 74 of transmitter part 52. As seen in FIG. 7, typical light rays entering back window 72 of transmitter part 52 as J and K will pass through transparent body 70 being internally reflected by the bottom and top surfaces of body 70 essentially as shown also in FIG. 2. Rays J and K will illuminate frosted front face 74 while other rays such as L, M and O will also be reflected internally by side 77 to illuminate front face 70 so that a reinforcement or concentration of light is obtained with the illumination of front face 74 being substantially greater than the intensity of the light falling originally on back window 72. The overall dimensions of roadway marker 48 may be about 4 inches by 4 inches by $\frac{5}{8}$ inch high, the width of back window 72 may be about twice the width of front face 74 and the area of light reflector element face 58 may be about one third of the total back area of roadway marker 48.

Roadway markers of this invention may be implanted in roadways to delineate lanes thereof as illustrated in FIGS. 3, 6 and 9, by placement in a shallow depression in roadway 82 and attached thereto by a suitable adhesive such as an epoxy composition as at 84.

Figure 11:
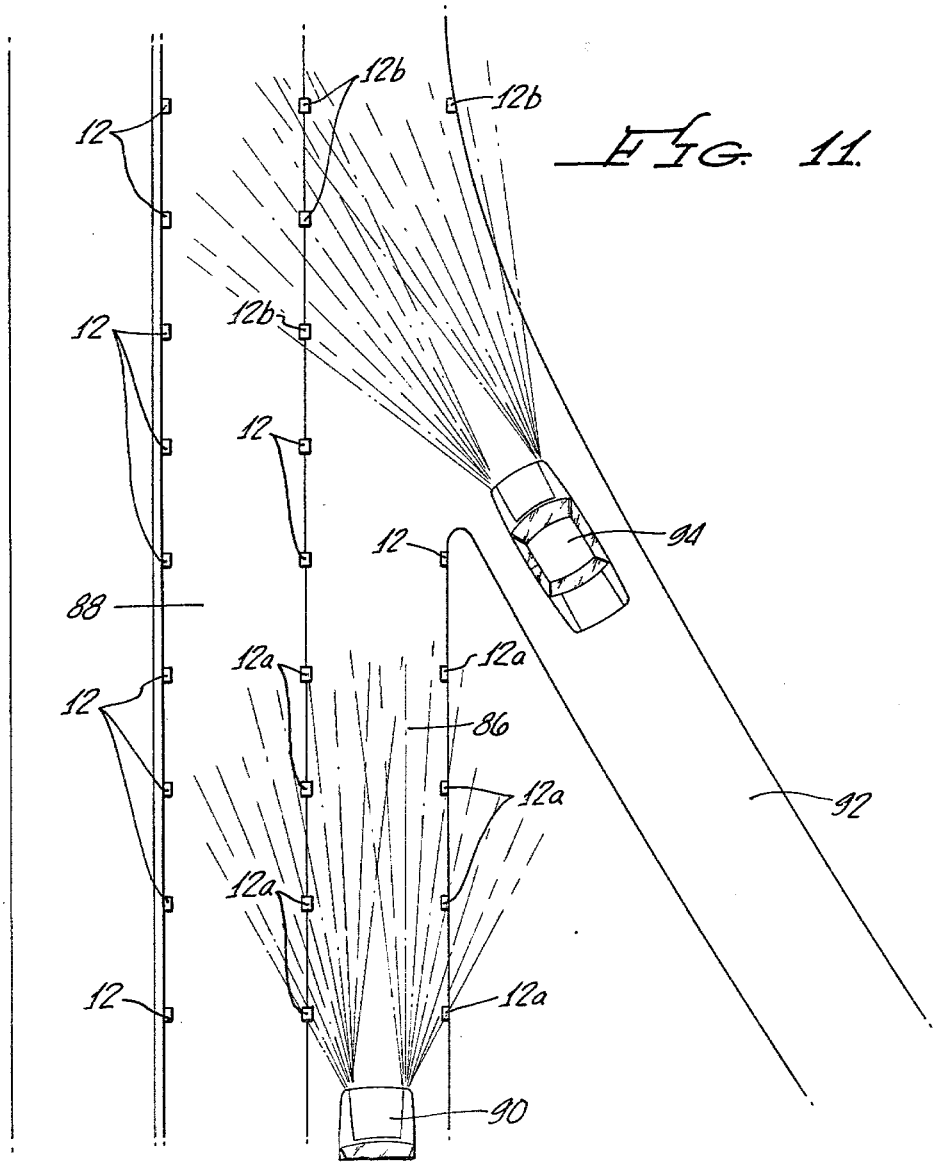
FIG. 11 shows in a fragmentary top view, a roadway marking system with lanes delineated by the roadway markers of this invention.

In operation, the roadway marker of this invention is implanted at spaced intervals along the edges of lanes of a multi-lane roadway to provide a system to delineate the lane in which a vehicle is travelling at night from positions generally ahead of the vehicle. The markers may be implanted and attached, as by an adhesive such as epoxy composition, to mark the outer edges and common middle edge of a double lane roadway, for example, as illustrated in FIG. 11. In this system inner lane 88 and outer lane 86 are parallel adjacent lanes having roadway markers, 12 for example, as described and illustrated in FIGS. 1 to 3, implanted at intervals as shown. The headlights of a vehicle 90, travelling in outer lane 86 at night, will illuminate markers 12 ahead of it, specifically markers 12*a*, and the light falling on the back windows 16 of these markers will be transmitted forward as shown and will be visible from positions ahead of vehicle 90. A merging ramp or road 92 is shown on which another vehicle 94 is just about to enter or merge into roadway lane 86. The driver of vehicle 94 can look back along roadway lane 86, either directly or through his rear view mirror, and seeing the brightly lit roadway markers 12*a* can readily determine that vehicle 90 is in outer lane 86 and not in inner lane 88. Warned of the danger he can slow down or stop until vehicle has passed and it is safe to enter lane 86. The headlights of vehicle 92 will to some extent illuminate markers 12*b* as he enters lane 86, providing indication of his entering lane location to drivers ahead of him.

In a comprehensive installation, markers 10 may be placed along all edges of the lanes of a multilane roadway as illustrated in FIG. 11. This provides lane indication from forward positions of vehicles in all lanes, and may be useful for a driver wishing to switch into another lane, for example, facing a situation somewhat similar to that facing a driver merging from an on-ramp. In a more limited embodiment, markers 12 may be placed at edges of the outside lane and at areas near or approaching on-ramp or merging side road junctions to provide positive lane delineation at the most dangerous locations.

The embodiment of FIGS. 1 to 3 provides a marker of simple construction without concentration of light from back window to front face. The illuminated front face will provide a light scattering area of about the same size as the back window. Although the light intensity is not increased the illuminated area is comparatively large. The embodiment of FIGS. 4 to 6 is advantageous to provide a marker in which the illuminated area of its front face is smaller, but the focused light provides greater intensity, that is a brighter though smaller light spot. An additional advantage of the illuminated band at the upper part of the front face is that this area is furthest removed from the roadway and will be less likely to be obscured by road gravel, accumulations of dirt and dust and other opaque deposits. The embodiment of FIGS. 7 to 9 provides a marker combining light transmitting characteristics with light reflection in a unitary structure. The light concentration by internal reflection in the transmitting part is effective to produce a brightly illuminated, relatively smaller area for excellent visibility from ahead viewpoints. The angled side design for light concentration is simple in that only plane surfaces are required and these may be less critical and more readily designed and manufactured than a body with a curvate back window. The combination of a light transmitter and reflector in a unitary structure is advantageous to provide the specific and quite different functions of each type in an integrated device enclosed, except for light reflecting and transmitting window and faces, in a common cover.

The term "translucent" is employed herein to denote a body that will transmit light but with sufficient diffusion (caused by the light scattering front face) to prevent the perception of distinct images. Any suitable transparent material may be employed for construction of the roadway marker body, considering strength, toughness, optical properties, ease of fabrication, and durability under road service conditions. Hard glass may be employed and is resistant to scratching and wear, but is somewhat brittle. Methyl methacrylate plastic such as LUCITE 147 or PLEXIGLAS V811 is suitable and provides easy working characteristics with good optical properties and satisfactory life. Conventional processes such as forming, molding, casting, machining, roughening, polishing and plating may be employed for producing roadway marker bodies and finished surfaces as required.

The term "back window" is employed herein to denote the polished and transparent surface facing the vehicle whose lights supply illumination. The term "front face" is employed herein to denote the light scattering surface viewed by the driver of another vehicle generally ahead of that supplying illumination. The light scattering front face of the roadway marker may be produced in a variety of configurations. It may be contoured in a ridged or waffle design as illustrated in FIGS. 1 to 3, or may be hob nailed or fluted or of other contour to scatter light received through the back window. As illustrated in FIGS. 4 to 9 the front face may be micro-contoured as by frosting to provide an effective light scattering area.

If desired the marker body, or its back window or front face may be suitably colored to produce colored light from its front face.

The valuable light transmitting properties of the roadway marker of this invention may be obtained as illustrated and described in a low profile structure with acutely angled back window and front face forming gradually sloping on and off ramps for easy passage of a rolling vehicle tire.

I claim:

1. A roadway marking system to delineate the lane in which a first vehicle is travelling at night comprising a series of light transmitting roadway markers attached at spaced intervals along the surface of a roadway, the illuminated front face of at least one of said light transmitting roadway markers adapted to be visible to the driver of a second vehicle generally ahead of said first vehicle, looking back toward said first vehicle to determine the lane in which said first vehicle is travelling, said light transmitting roadway markers each comprising:

a. a body fabricated of transparent material having a back window at one end to receive light from the headlights of said first vehicle travelling in a lane of said roadway; and, b. a light scattering front face at its other, opposite end illuminated by the light received on said back window and transmitted through said body.

2. A roadway marking system according to claim 1 in which said series of roadway markers is attached to at least one side edge of a lane of said roadway.

3. A roadway marking system according to claim 1 in which said series of light transmitting roadway markers are attached at spaced intervals along the surface of a roadway approaching the junction of said roadway with a merging side road.

* * * * *